US006220722B1

(12) United States Patent
Begemann

(10) Patent No.: US 6,220,722 B1
(45) Date of Patent: Apr. 24, 2001

(54) LED LAMP

(75) Inventor: Simon H. A. Begemann, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/397,741

(22) Filed: Sep. 16, 1999

(30) Foreign Application Priority Data

Sep. 17, 1998 (EP) ..... 98203104

(51) Int. Cl.[7] ..... F21V 9/00

(52) U.S. Cl. ..... 362/231; 362/226; 362/800; 362/294; 362/241; 362/555; 362/545

(58) Field of Search ..... 362/231, 294, 362/373, 545, 555, 547, 264, 230, 241, 247, 226, 800, 249; 313/35, 36

(56) References Cited

U.S. PATENT DOCUMENTS 4,727,289 * 2/1988 Uchida ..... 315/71
5,688,042 * 11/1997 Madadi et al. ..... 362/240
5,803,579 * 9/1998 Turnbull et al. ..... 362/83.1

FOREIGN PATENT DOCUMENTS 2239306 6/1991 (GB) ..... F21V/19/00
58082581 * 5/1983 (JP) ..... 257/98

* cited by examiner

*Primary Examiner*—Sandra O'Shea
*Assistant Examiner*—Guiyoung Lee

(57) ABSTRACT

The invention relates to a LED lamp having a gear column which is connected, at its first end, to a lamp cap and, at its other end, to a substrate. The substrate is provided with a regular polyhedron of at least four planes, the planes having at least one LED having a luminous flux of at least 5 lm. The gear column also have heat-dissipating means which interconnect the substrate and the lamp cap. A continuous and regular illumination with a high luminous flux can be obtained using a LED lamp of this type.

7 Claims, 4 Drawing Sheets

LED LAMP

BACKGROUND OF THE INVENTION

The invention relates to a LED lamp comprising a gear column, a lamp cap which is connected to an end of the gear column and a substrate which is connected to the other end of the gear column and which is provided with a number of LEDs.

Such a LED (Light Emitting Diode) lamp is known from English patent publication GB 2,239,306, which more particularly describes a LED lamp which can suitably be used for decorative purposes. The known lamp comprises a customary base with a BC cap or a continental screw cap, a gear column which accommodates the electronic gear necessary to operate the LEDs, as well as a substrate which is circularly symmetrical when viewed in the direction of the longitudinal axis of the lamp, in which substrate a number of individual LEDs are incorporated. The colors generated by the different LEDs during operation of the lamp may differ. By using an adjustable switching time control, it is possible to generate specific lighting effects and lighting patterns with the known lamp.

The known lamp has a number of drawbacks. One of these drawbacks is that the lamp can only be used for signaling purposes, whereby the LEDs of the lamp draw attention via a specific adjustable flashing frequency. The known lamp cannot provide for continuous, uniform lighting with a high luminous flux. In addition, the manufacture of the known lamp is relatively complicated. This applies in particular if the known lamp must be provided with a large number of LEDs.

SUMMARY OF THE INVENTION

It is an object of the invention to obviate the above-mentioned drawback. The invention more particularly aims at providing a LED lamp which can be relatively easily mass-produced, and which can be operated such that continuous, uniform lighting with a high luminous flux is obtained.

These and other objects of the invention are achieved by a LED lamp of the type mentioned in the opening paragraph, which is characterized in that the substrate comprises a regular polyhedron of at least four faces, whereby faces of the polyhedron are provided with at least one LED which, during operation of the lamp, has a luminous flux of at least 5 lm, and the gear column is provided with heat-dissipating means which interconnect the substrate and the lamp cap.

The invented lamp enables continuous, uniform, high-intensity lighting to be achieved. It has been found that LEDs having a luminous flux of 5 lm or more can only be efficiently used if the lamp comprises heat-dissipating means. Customary incandescent lamps can only be replaced by LED lamps which are provided with LEDs having such a high luminous flux. A particular aspect of the invention resides in that the heat-dissipating means remove the heat, generated during operation of the lamp, from the substrate via the gear column to the lamp cap and the mains supply connected thereto.

The use of a substrate which is composed of a regular polyhedron of at least four faces enables the intended uniform lighting to be achieved. The regular polyhedron is connected to the gear column, preferably, via a vertex. However, the polyhedron may in principle also be connected to the gear column in the center of one of the faces. The greatest uniformity in lighting is obtained if each one of the faces is provided with the same number of LEDs of the same type.

In experiments leading to the present invention, it has been found that favorable results can be achieved with polyhedrons in the form of an octahedron (regular polyhedron of eight faces) and dodecahedron (regular polyhedron of twelve faces). Better results, however, are achieved with substrates in the form of a hexahedron (polyhedron of six faces, cube). In practice it has been found that a good uniformity in light distribution can already be obtained using substrates in the form of a tetrahedron (regular polyhedron of four faces, pyramid). In an alternative embodiment the substrate comprises a three-dimensional body like a sphere or an ellipsoid, or a pat of a sphere or an ellipsoid.

A favorable embodiment of the LED lamp is characterized in that the lamp is also provided with a (semi-) transparent envelope. This envelope may be made of glass, but is preferably made of a synthetic resin. The envelope serves as a mechanical protection for the LEDs. In addition, the envelope may contribute to obtaining the uniform lighting which can be obtained with the lamp.

A further interesting embodiment of the LED lamp is characterized in that the heat-dissipating means comprise a metal connection between the substrate and the lamp cap. It has been found that such a connection, which may preferably consist of a layer of copper, properly dissipates the heat from the substrate to the lamp cap. In principle, the gear column may entirely consist of a heat-conducting material, for example a metal such as copper or a copper alloy. In this case, it must be ensured that the electronics present in the gear column is properly electrically insulated from the metal gear column. Preferably, also the substrate is made of a metal, such as copper or a copper alloy.

Yet another embodiment of the LED lamp is characterized in that means are incorporated in the column, which are used to generate an air flow in the lamp. Such means, preferably in the form of a fan, can be used, during operation of the lamp, to generate forced air cooling. In combination with the heat-dissipating means, this measure enables good heat dissipation from the gear column and the substrate.

A further embodiment of the invented LED lamp is characterized in that the faces of the polyhedron are provided with an array of LEDs, which preferably comprises at least one green, at least one red and at least one blue LED or at least one green, at least one red, at least one yellow and at least one blue LED or at least one white LED. By virtue of the shape of the substrate, such an array of LEDs can be readily provided, often as a separate LED array, on the faces of the substrate. This applies in particular when the faces of the polyhedral substrate are substantially flat. Such a LED array generally comprises a number of LEDs which are provided on a flat printed circuit board (PCB). In practice, LEDs cannot be readily secured to a substrate which is not level. If LEDs with a high luminous flux (5 lm or more) are used, then a so-called metal-core PCB is customarily used. Such PCBs have a relatively high heat conduction. By providing these PCBs on the (preferably metal) substrate by means of a heat-conducting adhesive, a very good heat dissipation from the LED arrays to the gear column is obtained.

By using one or more LED combinations in the colors green, red and blue or green, red, yellow and blue for each substrate face, a LED lamp can be obtained which emits white light. Such LED combinations composed of three different LEDs are preferably provided with a secondary optical system, in which the above-mentioned colors are blended so as to obtain white light. Another interesting embodiment of the LED lamp is characterized in that the lamp is provided with means for changing the luminous flux of the LEDs. If the gear column is provided with electronic gear suitable for this purpose, then this measure enables a dimmable LED lamp to be obtained. The dim function is preferably activated by means of an adjusting ring which is attached to the gear column at the location of the lamp cap. It is obvious that, if an envelope is used in the lamp, the adjusting ring must be situated outside the envelope.

A further interesting embodiment of the invented LED lamp is characterized in that the lamp is provided with means for mutually varying the luminous flux of the LEDs provided on the various faces of the substrate. The electronic gear necessary for this function is incorporated in the gear column of the lamp. By using this measure, it is possible to change the spatial light distribution of the LED lamp. If LEDs of different colors are used, it is also possible to adjust the color and the color distribution of the LED lamp. The distribution of the color and/or light distribution is preferably adjusted via an adjusting ring, which is connected to the gear column at the location of the lamp cap. It is obvious that, if an envelope is used in the lamp, the adjusting ring must be situated outside the envelope.

BRIEF DESCRIPTION OF THE DRAWINGS

It is noted that like parts in the different Figures are indicated by like reference numerals.

DETAILED DESCRIPTION OF THE PREFERRED EMBODIMENTS

Figure 1:
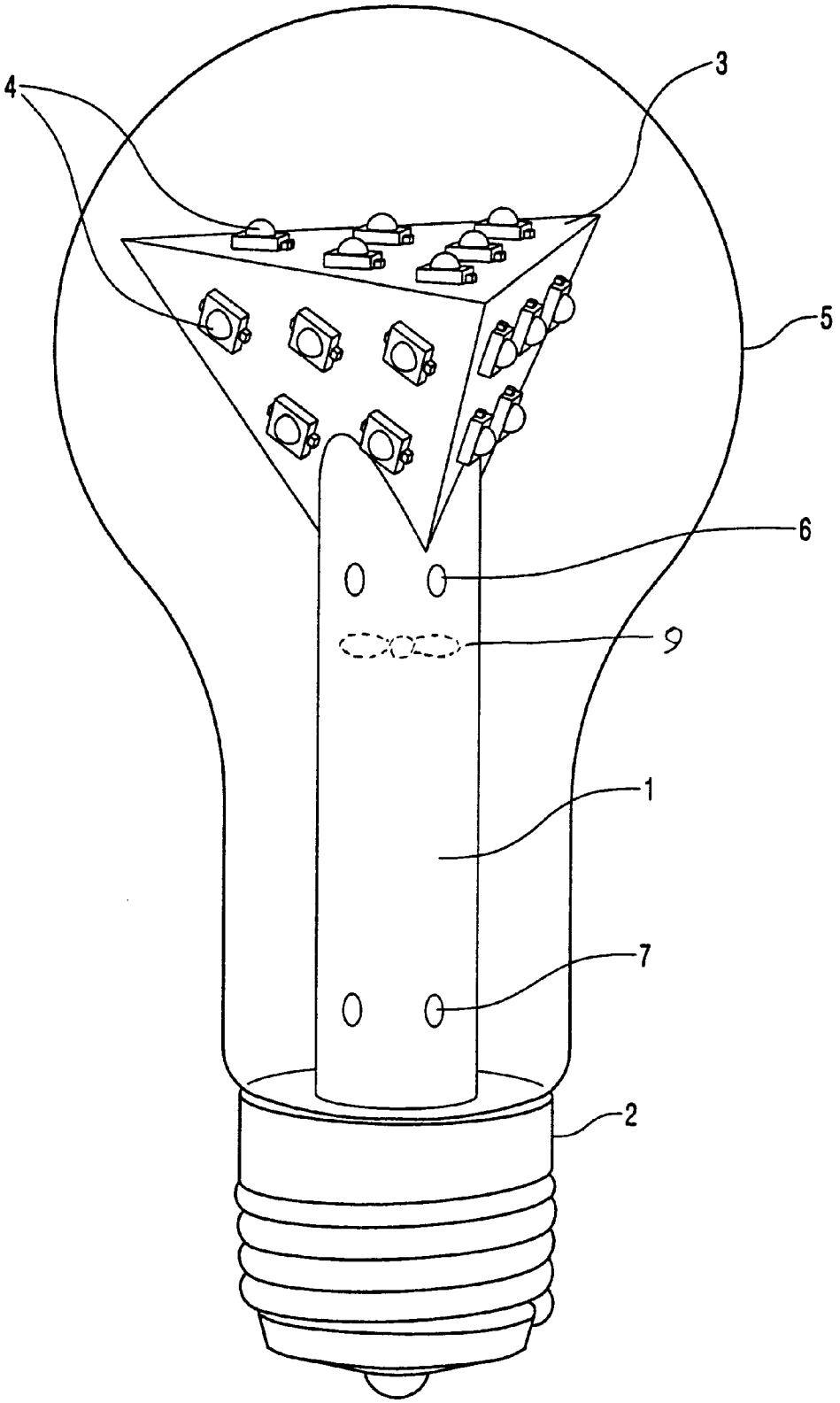
FIG. 1 is a view of a first embodiment of the invented LED lamp.

FIG. 1 shows a first embodiment of the invented Light-emitting giode lamp (LED lamp). This lamp comprises a tubular, hollow gear column (1), which is connected with one end to a lamp cap (2). The other end of the gear column (1) is connected to a substrate (3), which is provided with a number of LEDs (4). The space within the hollow gear column (1) accommodates the electronic gear necessary for controlling the LEDs (4). During operation of the lamp, these LEDs generate a luminous flux of 5 lm or more. The lamp is further provided with an envelope (5) of a synthetic resin, which envelops the gear column (1) and the substrate (3). It is emphasized that despite the presence of the envelope (5), the effect of the current invention in the LED lamp is achieved.

In the example described herein, the substrate (3) has the shape of a regular pyramid with four flat faces and is connected to the gear column (1) via a vertex of the pyramid. The outer surface of the substrate (3) is made of a metal or a metal alloy, thereby enabling a good heat conduction from the LEDs (4) to the column (1). In the present case, the outer surface of the substrate is made of a copper alloy. Each of the faces of the pyramid is provided with a number (five or six) LEDs (4), which are secured to the faces by means of a heat-conducting adhesive. In this example, single LEDs of the same type are used, which have only one light point per LED (commonly referred to as single-chip LED). Consequently, the LED lamp shown is monochromatic.

The outer surface of the gear column (1) of the LED lamp is made of a metal or a metal alloy. This enables a good heat conduction from the substrate (3) to the (metal) lamp cap (2) to be attained. In the present example, a copper alloy is used for the column. The use of the above-mentioned heat-dissipating means enables the LEDs with the relatively high luminous flux to be used without heat problems in a LED lamp of the above-described type.

The LED lamp shown in FIG. 1 also includes a fan (9) incorporated in the gear column (1), which fan generates an air flow during operation of the lamp. This air flow leaves the gear column (1) via holes (6) provided in the gear column, and re-enters the gear column via the holes (7) provided in the gear column. By suitably shaping and positioning the holes (6), the air flow is led past a substantial number of the LEDs present on the substrate (3). By virtue thereof, an improved heat dissipation from the substrate and the LEDs is obtained.

Figure 2:
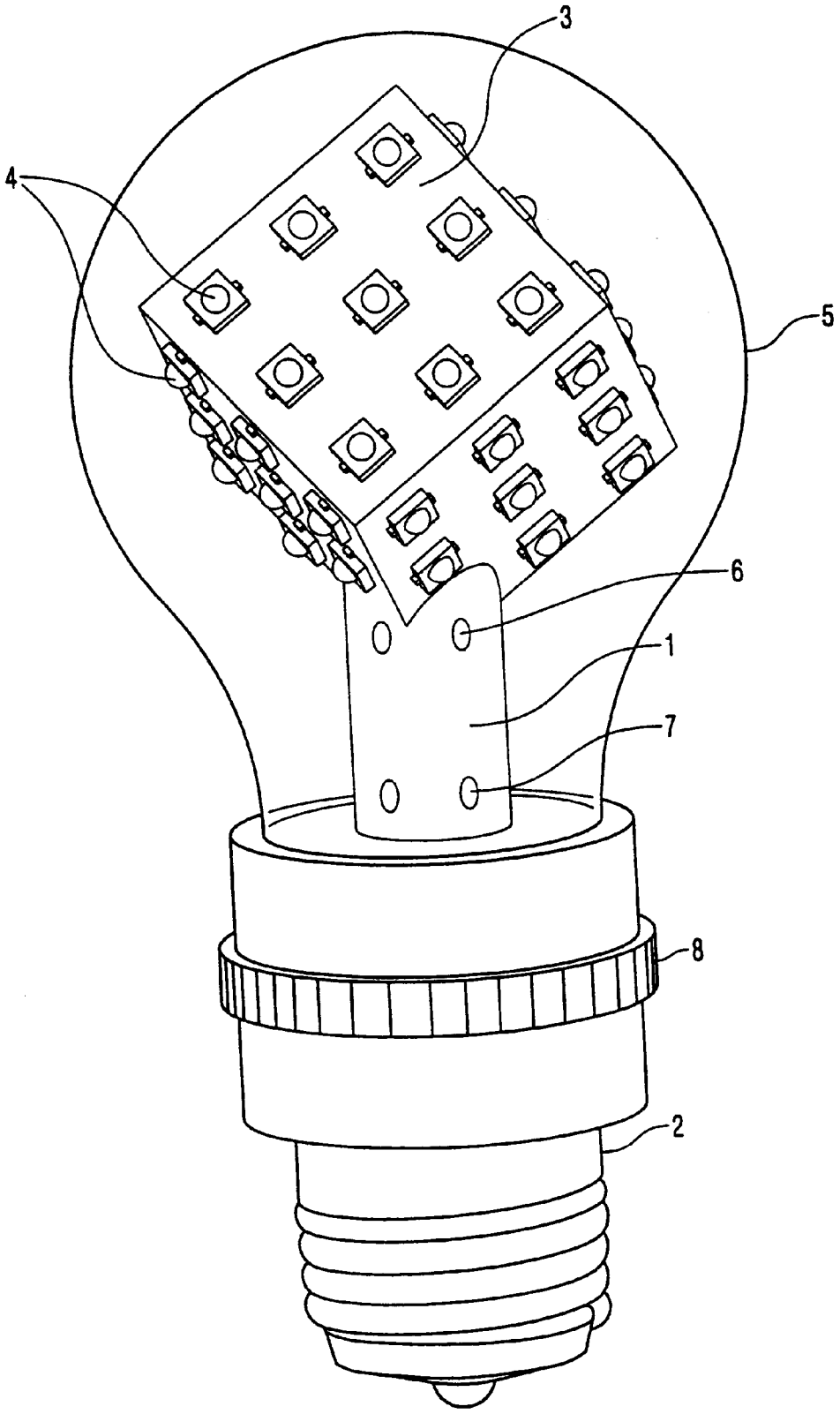
FIG. 2 is a view of a second embodiment of the invented LED lamp.
Figure 3C:
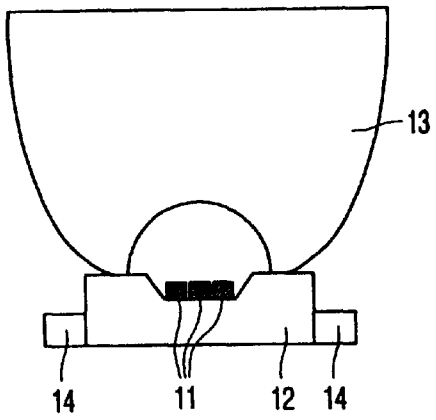
FIG. 3 is a diagrammatic, sectional view of two types of LEDs for use in the invented LED lamp.
Figure 3B:
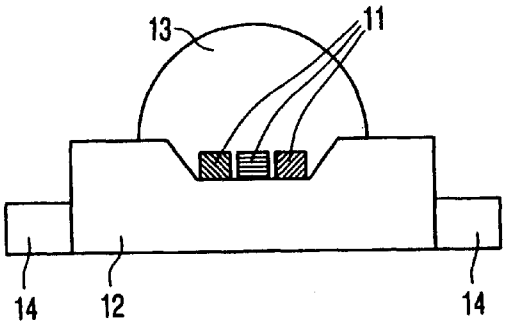
Figure 3A:
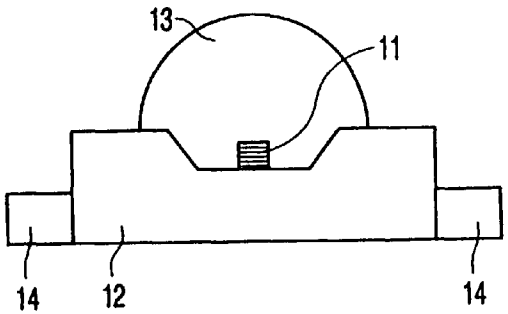
Figure 3D:
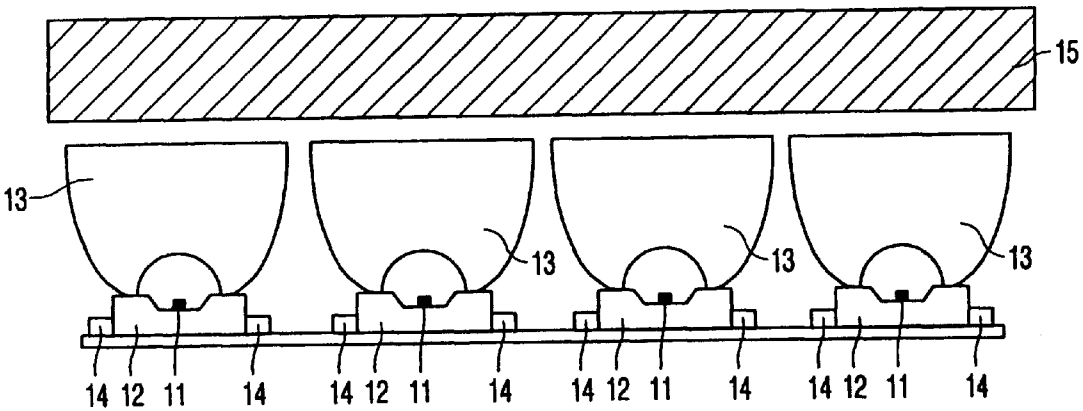

FIG. 2 shows a second embodiment of the invented LED lamp. Like the first embodiment, this embodiment comprises a gear column (1), a metal lamp cap (2), a metal substrate (3) with LEDs (4), an envelope (5) (not necessary), as well as outlet holes (6) and inlet holes (7) for an air flow generated by forced air cooling.

In the example described with respect to FIG. 2, the substrate (3) is cube-shaped with six flat faces, and is connected to gear column (1) via a vertex of the cube. The substrate (3) is made of a metal or a metal alloy, thereby enabling a good heat conduction from the LEDs (4) to the gear column (1) to be achieved. In the present case, the substrate is made of a copper alloy. Each one of the faces of the pyramid is provided with a number of (eight or nine) LEDs (4), which are secured to the faces by means of a heat-conducting adhesive. In this example, multiple-chip LEDs are used, which each have three light points (green, red and blue) per LED or four light points (green, red, yellow, blue) per LED. These colors are mixed so as to obtain white light in the secondary optical system of each of the LEDs. Consequently, during operation of the LED lamp shown, white light is obtained.

The LED lamp in accordance with FIG. 2 is also provided with an adjusting ring (8) for simultaneously changing the luminous flux of the LEDs. By means of this adjusting ring, the lamp can be dimmed as it were. The lamp may also be provided with a second adjusting ring (not shown), by means of which the luminous flux of the LEDs provided on different faces of the substrate can be changed with respect to each other. This measure enables the spatial light distribution of the lamp to be adjusted. The lamp may also be provided with a further adjusting ring (not shown), by means of which the luminous flux of the three light points of each LED can be changed with respect to each other. This measure enables the color of the light emitted by the lamp to be changed.

FIG. 3 is a schematic, sectional view of three types of LEDs (4) which can suitably be used in the invented LED lamp. FIG. 3-A shows a LED which comprises single-chip LEDs, which each have only one light point (11) per LED. This light point (11) is placed on a so-called MC-PCB (12), which is responsible for a good heat transfer. Light point (11) is provided with a primary optical system (13), by means of which the radiation characteristic of the LED can be influenced. The LED (4) is also provided with two electrical connections (14). Via these connections, the LED is soldered onto the substrate (3). A heat-conducting adhesive between MC-PCB (12) and substrate (3) is responsible for a good heat dissipation from the LED to the substrate.

FIG. 3-B shows so-called multiple-chip LEDs, which each have three light points (11) (green, red and blue) per LED. If necessary, these three colors are blended so as to obtain white light in the primary optical system (13) of each one of the LEDs. A better color blending to form white light is obtained if a secondary mixing optics is additionally provided above the multiple-chip LEDs. This situation is shown in FIG. 3-C. Also these multiple-chip LEDs comprise a so-called MC-PCB (12) and connections (14).

If single-chip LEDs (4) in the colors green, red and blue are employed on the substrate (3), it is convenient to group these LEDs in trios, and provide a further secondary optical system (15) above the primary optical systems. In this manner, a good color blending of green, red and blue light is obtained. This situation is diagrammatically shown in FIG. 3-D.

Figure 4:
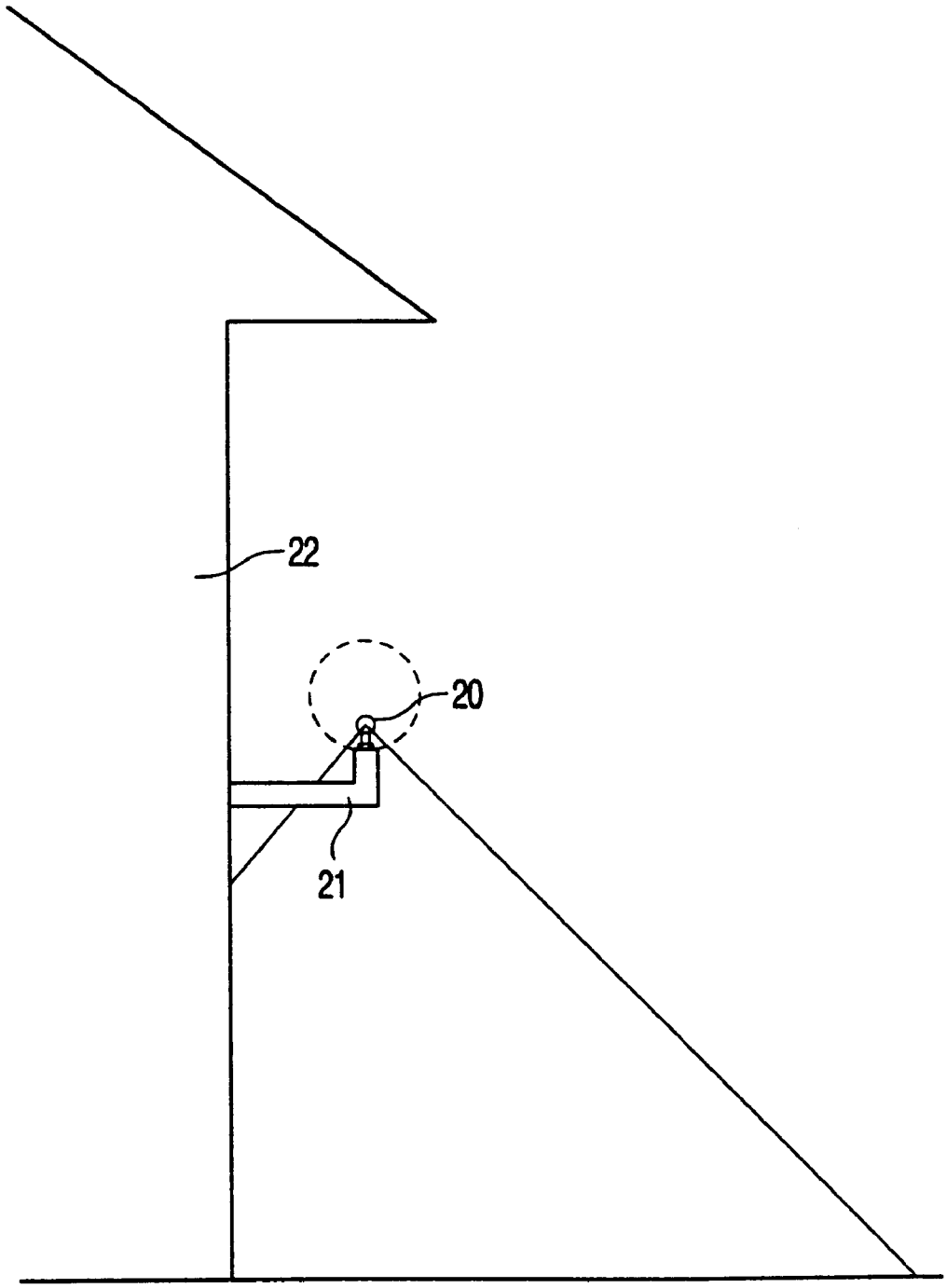
FIG. 4 shows an example of a possible application of the invented LED lamp.

FIG. 4 diagrammatically shows an application of a LED lamp, which requires an asymmetric light distribution. The LED lamp (20) is used as outdoor lighting and is situated on a holder (21) which is secured to the wall (22) of a building. The necessary luminous flux in the direction of the wall is much smaller than that in the opposite direction. The asymmetric light distribution required for this purpose can be simply adjusted by means of a LED lamp as described with reference to FIG. 3.

The LED lamp in accordance with the invention can be readily manufactured and exhibits, during operation of the lamp, a relatively high luminous flux.

What is claimed is:

1. A LED lamp comprising a gear column, a lamp cap which is connected to an end of the gear column and a substrate which is connected to the other end of the gear column, wherein the substrate comprises a regular polyhedron of at least four faces, wherein faces of the polyhedron are each provided with at least one LED which, during operation of the lamp, has a luminous flux of at least 5 lm, and wherein the column comprises heat-dissipating means interconnecting the substrate and the lamp cap.

2. A LED lamp as claimed in claim 1, characterized in that the lamp is also provided with a (semi-)transparent envelope.

3. A LED lamp as claimed in claim 1, characterized in that the heat-dissipating means comprise a metal connection between the substrate and the lamp cap.

4. A LED lamp as claimed in claim 1, further comprising cooling means in the gear column, which are used to generate an air flow in the lamp.

5. A LED lamp as claimed in claim 1, characterized in that the faces of the polyhedron are provided with an array of LEDs, which preferably comprises at least one green, at least one red and at least one blue LED or at least one green, at least one red, at least one yellow and at least one blue LED or at least one white LED.

6. A LED lamp as claimed in claim 1, characterized in that the lamp is provided with means for changing the luminous flux of the LEDs.

7. A LED lamp as claimed in claim 1, characterized in that the lamp is provided with means for mutually varying the luminous flux of the LEDs provided on the various faces of the substrate.

* * * * *